US007712173B2

(12) United States Patent
Labonté

(10) Patent No.: US 7,712,173 B2
(45) Date of Patent: May 11, 2010

(54) METHOD OF MANUFACTURING AN ICE SKATE

(75) Inventor: Ivan Labonté, Montreal (CA)

(73) Assignee: Bauer Hockey, Inc., Greenland, NH (US)

( * ) Notice: Subject to any disclaimer, the term of this patent is extended or adjusted under 35 U.S.C. 154(b) by 0 days.

(21) Appl. No.: 12/385,019

(22) Filed: Mar. 30, 2009

(65) Prior Publication Data

US 2009/0188056 A1 Jul. 30, 2009

Related U.S. Application Data

(62) Division of application No. 11/057,766, filed on Feb. 15, 2005, now Pat. No. 7,533,479.

(51) Int. Cl.
*A43D 11/00* (2006.01)
*A43B 5/00* (2006.01)

(52) U.S. Cl. ..... 12/146 C; 12/142 P; 36/114; 36/115

(58) Field of Classification Search ..... 36/45, 36/114, 115, 88; 12/146 C, 142 P
See application file for complete search history.

(56) References Cited

U.S. PATENT DOCUMENTS 5,669,160 A 9/1997 Pozzebon
6,499,233 B1 12/2002 Chenevert
6,505,422 B2 1/2003 Racine
6,647,576 B2 * 11/2003 Racine ..... 12/142 P
6,748,676 B1 6/2004 Chenevert
6,769,203 B1 8/2004 Wright et al.
6,871,424 B2 3/2005 Labonté et al.
7,316,083 B2 1/2008 Labonté
2005/0188564 A1 9/2005 Delgorgue et al.

* cited by examiner

*Primary Examiner*—Marie Patterson

(57) ABSTRACT

A method of manufacturing an ice skate for enclosing a human foot when in use, the foot having a heel, an ankle with a medial malleolus and a lateral malleolus, a plantar surface, medial and lateral sides and toes. The method comprises (a) providing a sheet of thermoformable material; (b) thermoforming the sheet of thermoformable material to form an outer shell comprising (i) a heel portion for receiving the heel of the foot; (ii) an ankle portion for receiving the ankle; (iii) medial and lateral side portions for facing the medial and lateral sides of the foot respectively, the medial and lateral side portions extending forwardly from the heel portion and the ankle portion, one of the medial and lateral side portions comprising a skirt portion being integrally formed therewith; (c) folding the skirt portion to form a sole having an upper surface for facing the plantar surface of the foot and a bottom surface; and (d) mounting an ice skate blade holder to the bottom surface of the sole.

16 Claims, 11 Drawing Sheets

METHOD OF MANUFACTURING AN ICE SKATE

CROSS-REFERENCE TO RELATED APPLICATION

This application is a divisional application of U.S. patent application Ser. No. 11/057,766 filed on Feb. 15, 2005. now U.S. Pat. No. 7,533,479.

FIELD OF THE INVENTION

The present invention relates to a method of making an ice skate.

BACKGROUND OF THE INVENTION

The construction of sporting boots used for sporting activities such as ice skating, roller skating, hiking, trekking and cross-country skiing has become quite complex over recent years. Existing sporting boots often include multiple different components, and multiple different materials in order to provide the sporting boot with the performance and aesthetic requirements imposed by consumers. As such, over recent years different manufacturing processes have been developed and new materials have ,been used.

The most recent trend in sporting boot construction is to manufacture a sporting boot using lightweight components, and where possible with a reduced number of components.

Accordingly, there is a need in the industry for a sporting boot that is lighter and/or has less components than existing skate boots.

SUMMARY OF THE INVENTION

In accordance with a first broad aspect, the invention provides a sporting boot for enclosing a human foot when in use, the foot having a heel, an ankle with a medial malleolus and a lateral malleolus, a plantar surface, medial and lateral sides and toes, the sporting boot comprising (a) an outer shell made of a thermoformable material, the outer shell being thermoformed such that it comprises: (i) a heel portion for receiving the heel of the foot; (ii) an ankle portion for receiving the ankle; (iii) medial and lateral side portions for facing the medial and lateral sides of the foot respectively; and (iv) a skirt portion integrally formed with one of the medial and lateral side portions, the skirt portion being folded inwardly to form a sole having an upper surface for facing the plantar surface of the foot and a bottom surface; and (b) an outsole mounted to the bottom surface of the sole.

In accordance with a second broad aspect, the present invention provides a sporting boot for enclosing a human foot when in use, the foot having a heel, an ankle with a medial malleolus and a lateral malleolus, a plantar surface, medial and lateral sides and toes, the sporting boot comprising (a) an outer shell made of a thermoformable material, the outer shell being thermoformed such that it comprises: (i) a heel portion for receiving the heel of the foot; (ii) an ankle portion for receiving the ankle; (iii) medial and lateral side portions for facing the medial and lateral sides of the foot respectively; and (iv) a medial skirt portion integrally formed with the medial side portion and a lateral skirt portion integrally formed with the lateral side portion, the medial and lateral skirt portions being folded inwardly to form a sole having an upper surface for facing the plantar surface of the foot and a bottom surface; and (b) an outsole mounted to the bottom surface of the sole.

In accordance with a third broad aspect, the present invention provides a skate boot for enclosing a human foot when in use, the foot having a heel, an ankle with a medial malleolus and a lateral malleolus, a plantar surface, medial and lateral sides and toes, the skate boot comprising an outer shell made of thermoformable material, the outer shell being thermoformed such that it comprises: (a) a heel portion for receiving the heel of the foot; (b) an ankle portion for receiving the ankle; (c) medial and lateral side portions for facing the medial and lateral sides of the foot respectively; and (d) a skirt portion integrally formed with one of the medial and lateral side portions, the skirt portion being folded inwardly to form a sole having an upper surface for facing the plantar surface of the foot and a bottom surface.

In accordance with a fourth broad aspect, the present invention provides a skate boot for enclosing a human foot when in use, the foot having a heel, an ankle with a medial malleolus and a lateral malleolus, a plantar surface, medial and lateral sides and toes, the skate boot comprising an outer shell made of thermoformable material, the outer shell being thermoformed such that it comprises: (a) a heel portion for receiving the heel of the foot; (b) an ankle portion for receiving the ankle; (c) medial and lateral side portions for facing the medial and lateral sides of the foot respectively; and (d) a medial skirt portion integrally formed with the medial side portion and a lateral skirt portion integrally formed with the lateral side portion, the medial and lateral skirt portions being folded inwardly to form a sole having an upper surface for facing the plantar surface of the foot and a bottom surface.

In accordance with a fifth broad aspect, the invention provides an ice skate comprising: (a) a skate boot comprising an outer shell made of thermoformable material, the outer shell being thermoformed such that it comprises: (i) a heel portion for receiving the heel of the foot; (ii) an ankle portion for receiving the ankle; (iii) medial and lateral side portions for facing the medial and lateral sides of the foot respectively; and (iv) a skirt portion integrally formed with one of the medial and lateral side portions, the skirt portion being folded inwardly to form a sole having an upper surface for facing the plantar surface of the foot and a bottom surface; and (b) an ice skate blade holder mounted on the bottom surface of the sole.

In accordance with a sixth broad aspect, the invention provides a method of manufacturing a sporting boot for enclosing a human foot when in use, the foot having a heel, an ankle with a medial malleolus and a lateral malleolus, a plantar surface, medial and lateral sides and toes, the method comprising: (a) providing a sheet of thermoformable material; (b) thermoforming the sheet of thermoformable material to form an outer shell comprising (i) a heel portion for receiving the heel of the foot; (ii) an ankle portion for receiving the ankle; (iii) medial and lateral side portions for facing the medial and lateral sides of the foot respectively, the medial and lateral side portions extending forwardly from the heel portion and the ankle portion, one of the medial and lateral side portions comprising a skirt portion being integrally formed therewith; (c) folding the skirt portion to form a sole having an upper surface for facing the plantar surface of the foot and a bottom surface; and (d) affixing an outsole to the bottom surface of the sole.

In accordance with a seventh broad aspect, the invention provides a method of manufacturing a sporting boot for enclosing a human foot when in use, the foot having a heel, an ankle with a medial malleolus and a lateral malleolus, a plantar surface, medial and lateral sides and toes, the method comprising: (a) providing a sheet of thermoformable material; (b) thermoforming the sheet of thermoformable material to form an outer shell that comprises: (i) a heel portion for receiving the heel of the foot; (ii) an ankle portion for receiving the ankle; (iii) medial and lateral side portions for facing the medial and lateral sides of the foot respectively, the medial and lateral side portions extending forwardly from the heel portion and the ankle portion; the medial and lateral side portions each comprising a respective medial and lateral skirt portion being integrally formed therewith; (c) folding the medial and lateral skirt portions inwardly to form a sole having an upper surface for facing the plantar surface of the foot and a bottom surface; and (d) affixing an outsole to the bottom surface of the sole.

In accordance with a eighth broad aspect, the invention provides a method of manufacturing an ice skate for enclosing a human foot when in use, the foot having a heel, an ankle with a medial malleolus and a lateral malleolus, a plantar surface, medial and lateral sides and toes, the method comprising: (a) providing a sheet of thermoformable material; (b) thermoforming the sheet of thermoformable material to form an outer shell comprising (i) a heel portion for receiving the heel of the foot; (ii) an ankle portion for receiving the ankle; (iii) medial and lateral side portions for facing the medial and lateral sides of the foot respectively, the medial and lateral side portions extending forwardly from the heel portion and the ankle portion, one of the medial and lateral side portions comprising a skirt portion being integrally formed therewith; (c) folding the skirt portion to form a sole having an upper surface for facing the plantar surface of the foot and a bottom surface; and (d) mounting an ice skate blade holder to the bottom surface of the sole.

In accordance with a ninth broad aspect, the invention provides a method of manufacturing an ice skate for enclosing a human foot when in use, the foot having a heel, an ankle with a medial malleolus and a lateral malleolus, a plantar surface, medial and lateral sides and toes, the method comprising: (a) providing a sheet of thermoformable material; (b) thermoforming the sheet of thermoformable material to form an outer shell that comprises: (i) a heel portion for receiving the heel of the foot; (ii) an ankle portion for receiving the ankle; (iii) medial and lateral side portions for facing the medial and lateral sides of the foot respectively, the medial and lateral side portions extending forwardly from the heel portion and the ankle portion; the medial and lateral side portions each comprising a respective medial and lateral skirt portion being integrally formed therewith; (c) folding the medial and lateral skirt portions inwardly to form a sole having an upper surface for facing the plantar surface of the foot and a bottom surface; and (d) mounting an ice skate blade holder to the bottom surface of the sole.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of examples of embodiments of the present invention is provided hereinbelow with reference to the following drawings, in which.

Figure 1:
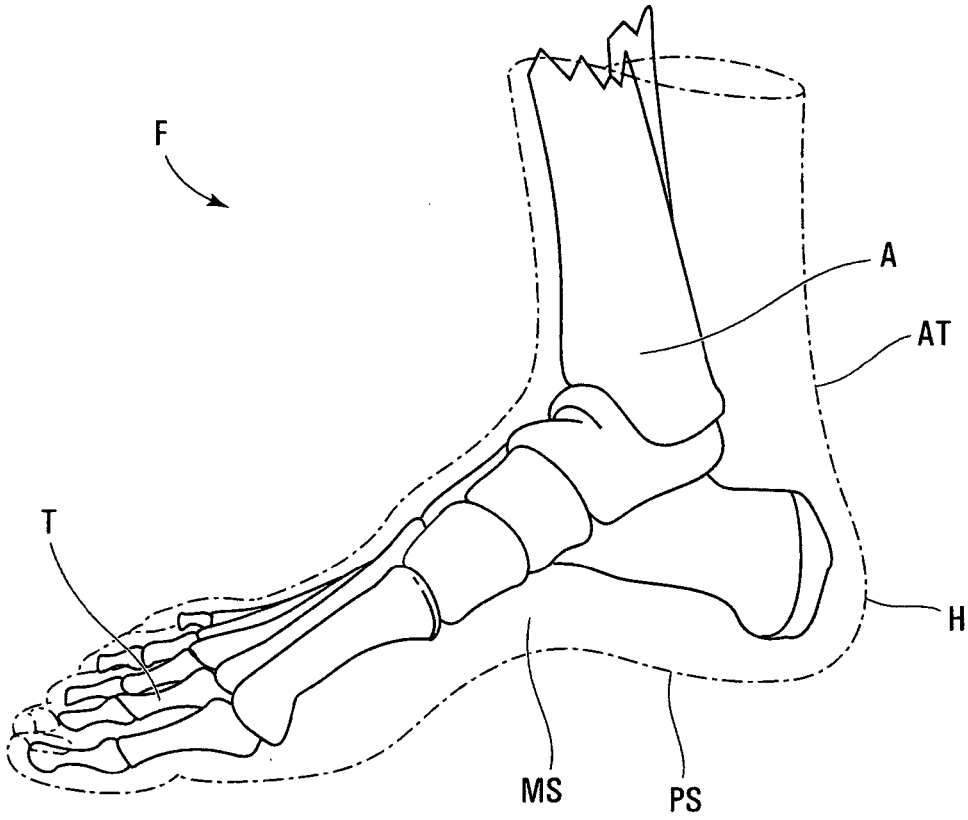
FIG. 1 is a side view of a human foot with the integument of the foot shown in stippled lines and the bones shown in solid lines.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION OF THE EMBODIMENTS

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Figure 2:
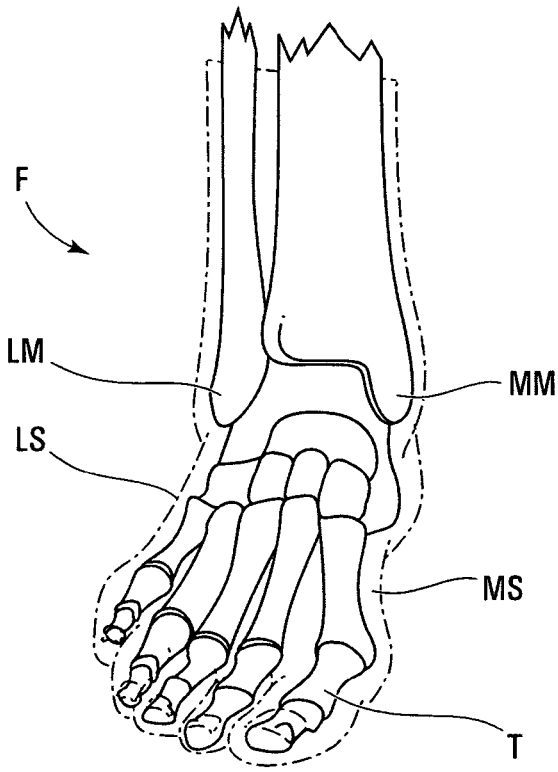
FIG. 2 is a front view of the human foot of FIG. 1.

Shown in FIGS. 1 and 2 is a typical human foot F that includes toes T, a plantar surface PS, a medial side MS and a lateral side LS. In addition, the human foot includes a heel H, an Achilles tendon AT and an ankle A having a lateral malleolus LM and a medial malleolus MM, the lateral malleolus LM being at a lower position than the medial malleolus MM.

Figure 3:
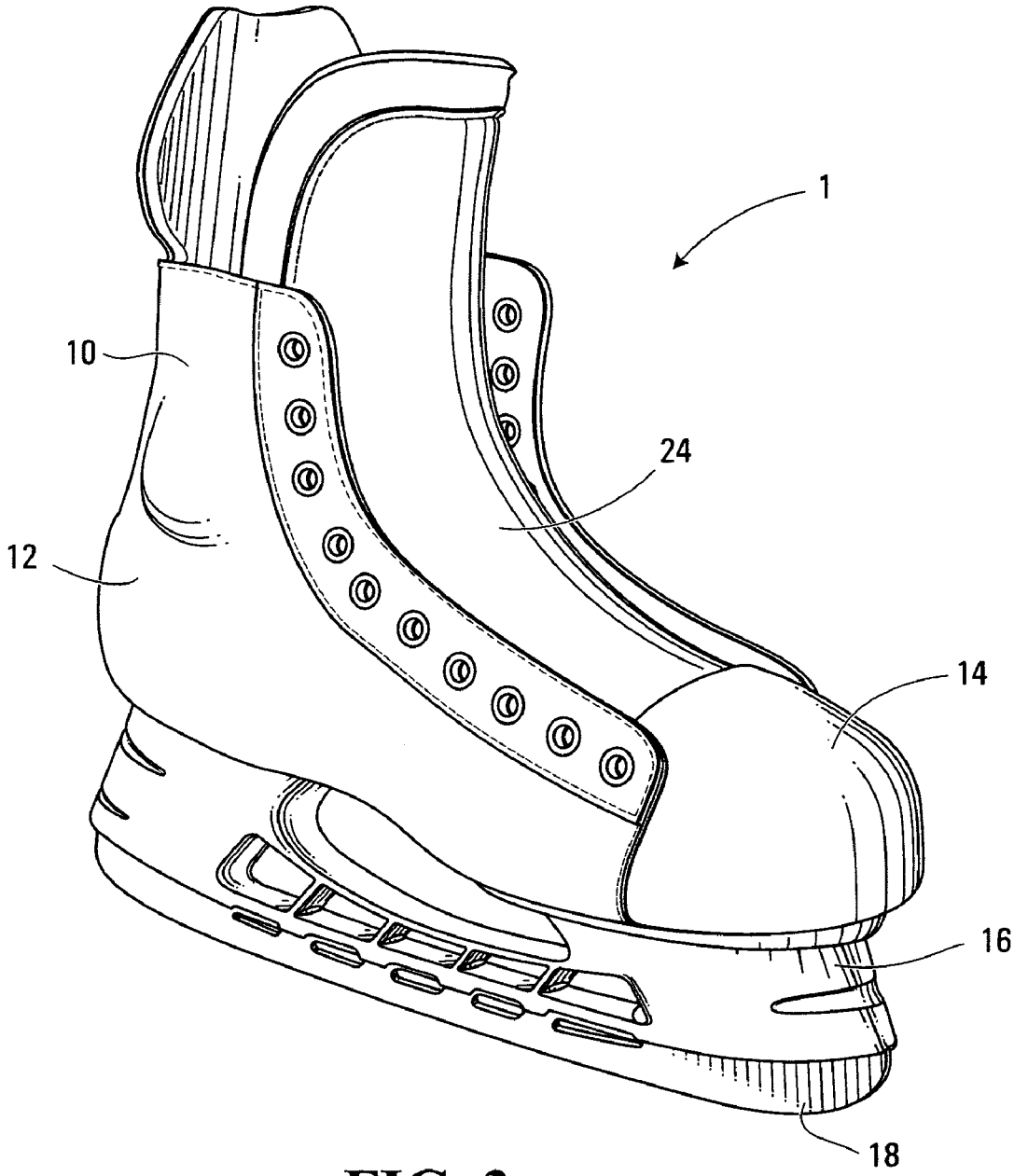
FIG. 3 is a perspective view of an ice skate comprising an outer shell in accordance with a first embodiment of the present invention.
Figure 4:
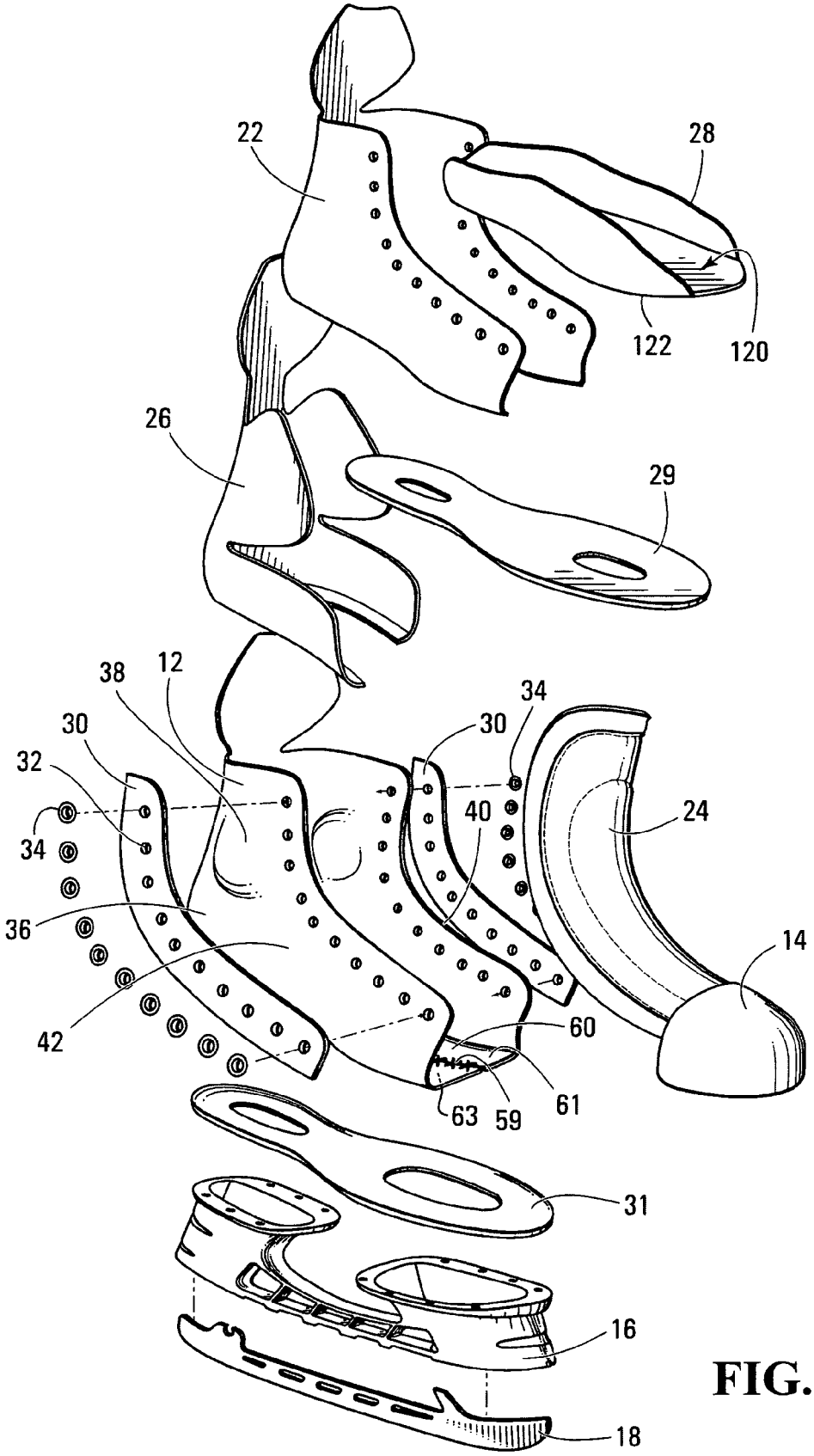
FIG. 4 is an exploded view of the ice skate of FIG. 3.

Shown in FIGS. 3 and 4 is an ice skate 1 that comprises a sporting boot 10 suitable for enclosing a right human foot F. Although the sporting boot 10 shown in the figures is being used for an ice skate 1, it is understood that the sporting boot 10 can be used for a variety of different sporting activities such as roller skating, hiking, trekking, football, basketball, soccer and cross-country skiing. A person skilled in the art will understand that variations, modifications and refinements are possible. For example, a roller chassis or a walking, hiking, trekking, cross-country skiing, football, basketball, or soccer outsole can replace the ice skate blade holder 16. Moreover, for a shoe, it is understood that the medial and lateral sides around the ankle A may not extend as high up as the medial and lateral sides of a skate and there is not necessarily a need for a rear upper portion covering the Achilles tendon AT.

As best shown in FIG. 4, the ice skate 1 has outer shell 12, a toe cap 14, a tongue 24, a rigid ankle support 26 (optional component), an inner lining 22, a footbed 28, an insole 29 (optional component), an outsole 31 (optional component), an ice skate blade holder 16 and a blade 18.

The outer shell 12 will now be described in more detail below with respect to FIGS. 4 to 6. The outer shell 12 is made of a thermoformable material. As used herein, the expression "thermoformable material" refers to a material that is capable of softening when heated and of hardening again when cooled. Some non-limiting examples of different types of thermoformable material comprise ethylene vinyl acetate (EVA) foam, polyethylene foam, polystyrene foam, polypropylene foam and thermoformable materials sold under the trade-marks MEGABIX®, SURLYN®, SONTARA®, FORMO500®, BYLON®, MOSOCA® and NYLON® 66.

The outer shell 12 is thermoformed such that it comprises a heel portion 36 for receiving the heel H, an ankle portion 38 for receiving the ankle A and medial and lateral side portions 40, 42 for facing the medial and lateral sides MS, LS respectively. These components form a foot receiving cavity that conforms to the general shape of the foot F. The medial and lateral side portions 40, 42 extend forwardly from the heel portion 36. The heel portion 36 is substantially cup shaped for following the contour of the heel H. The outer shell 12 has an inner surface 44 facing the foot F when in use, and an outer surface 46. For a skate, the outer shell 12 may comprise a tendon guard portion 48 covering the Achilles tendon AT.

In addition, the ankle portion 38 comprises medial and lateral ankle sides 62, 64 respectively. The medial ankle side 62 has a medial cup-shaped depression 52 for receiving the medial malleolus MM and the lateral ankle side 64 has a lateral cup-shaped depression 54 for receiving the lateral malleolus LM. The lateral depression 54 is located slightly lower than the medial depression 52, for conforming to the morphology of the foot F.

The medial and lateral side portions 40, 42 of the outer shell 12 comprise respective medial and lateral skirt portions 56, 58 that are integrally formed therewith and extend therefrom. As shown in FIG. 6, in order to complete the outer shell 12, the medial and lateral skirt portions 56, 58 are folded inwardly to form a sole 60 having an upper surface 61 for facing a substantial portion of the plantar surface PS and a bottom surface 63 for receiving an outsole, a blade holder or a roller chassis.

As shown in FIG. 4, the boot 10 may comprises the insole 29 that has an upper surface for facing the plantar surface PS of the foot and a bottom surface on which the upper surface 61 of the sole 60 may be affixed. The boot 10 may also comprise the outsole 31 that has a bottom surface of which the blade holder 16 is mounted. It is however understood that the insole 29 and outsole 31 are optional components and may be eliminated. Alternatively, only the outsole 31 may be eliminated and the insole 29 may still be used in the construction of the boot 10 if the sole 60 is sufficiently rigid for receiving the blade holder 16 or a roller chassis.

Figure 6:
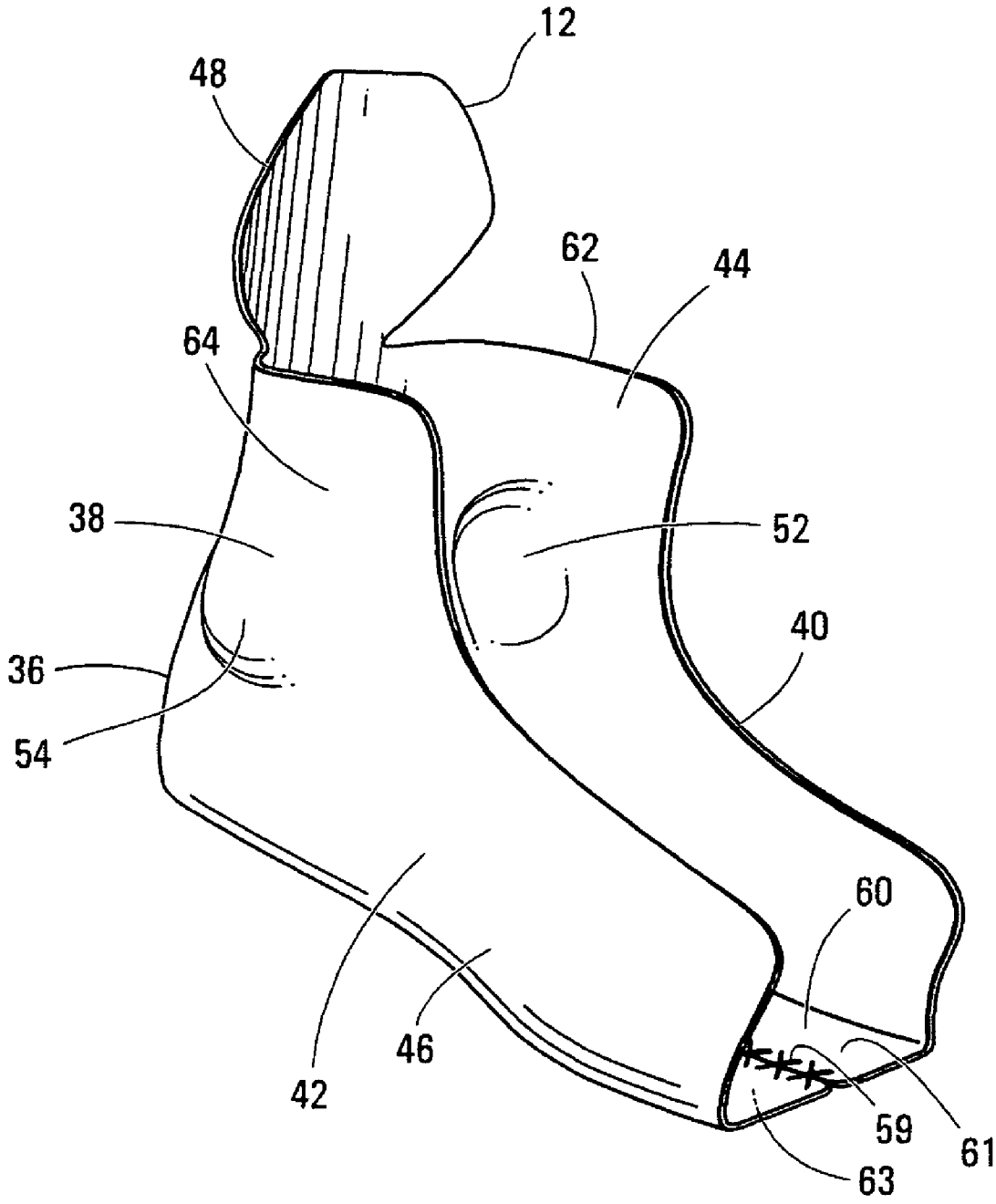
FIG. 6 is a perspective view of the outer shell of FIGS. 3 and 4.

As shown in FIGS. 4 and 6, the medial and lateral skirt portions 56, 58 may be affixed together via stitching 59. It should however be understood that the skirt portions 56, 58 could be affixed together in a variety of different manners without departing from the spirit of the invention. For example, the medial and lateral skirt portions 56, 58 could be affixed together via thermal bonding, piping, zipper, adhesive or staples. Alternatively, the medial and lateral skirt portions 56, 58 could be affixed together via interlocking components that fit together in order to affix the two skirt portions together. For example, one of the skirt portions can include an arrangement of grooves, and the other skirt portion can include an arrangement of corresponding projections that are able to interlock with the grooves. As such, by interlocking the corresponding grooves and projections, the medial and lateral skirt portions can be affixed together.

It is to be understood that the sole 60 may not face the entire plantar surface PS of the foot F. As shown in FIGS. 4 and 6, the upper surface 61 of the sole 60 does not face the entire bottom surface of the toes T. Moreover, it is possible that the medial and lateral skirt portions 56, 58 do not project from the entire length of the medial and lateral side portions 40, 42, and instead only begin to project from the medial and lateral side portions 40, 42 a few inches forward from the heel portion 36. In such an embodiment, when the skirt portions 56, 58 are folded inwardly, the sole 60 will not include a portion for facing the entire heel H. In a further example, it is possible that when the medial and lateral skirt portions 56, 58 are folded inwardly, there remains a small gap between the two skirt portions 56, 58, such that the upper surface 61 of the sole 60 does not face a portion of the foot F along a longitudinal line of the outer shell 12. In that sense, the sole 60 may only face a portion of the plantar surface PS. In fact, as used herein, the terms "the sole faces the plantar surface of the foot" must be understood as referring to a sole having a surface that is sufficient for supporting the foot and/or for allowing mounting the blade holder on the bottom surface of this sole and/or to a sole having a surface that does not cover the entire plantar surface of the foot.

Figure 5:
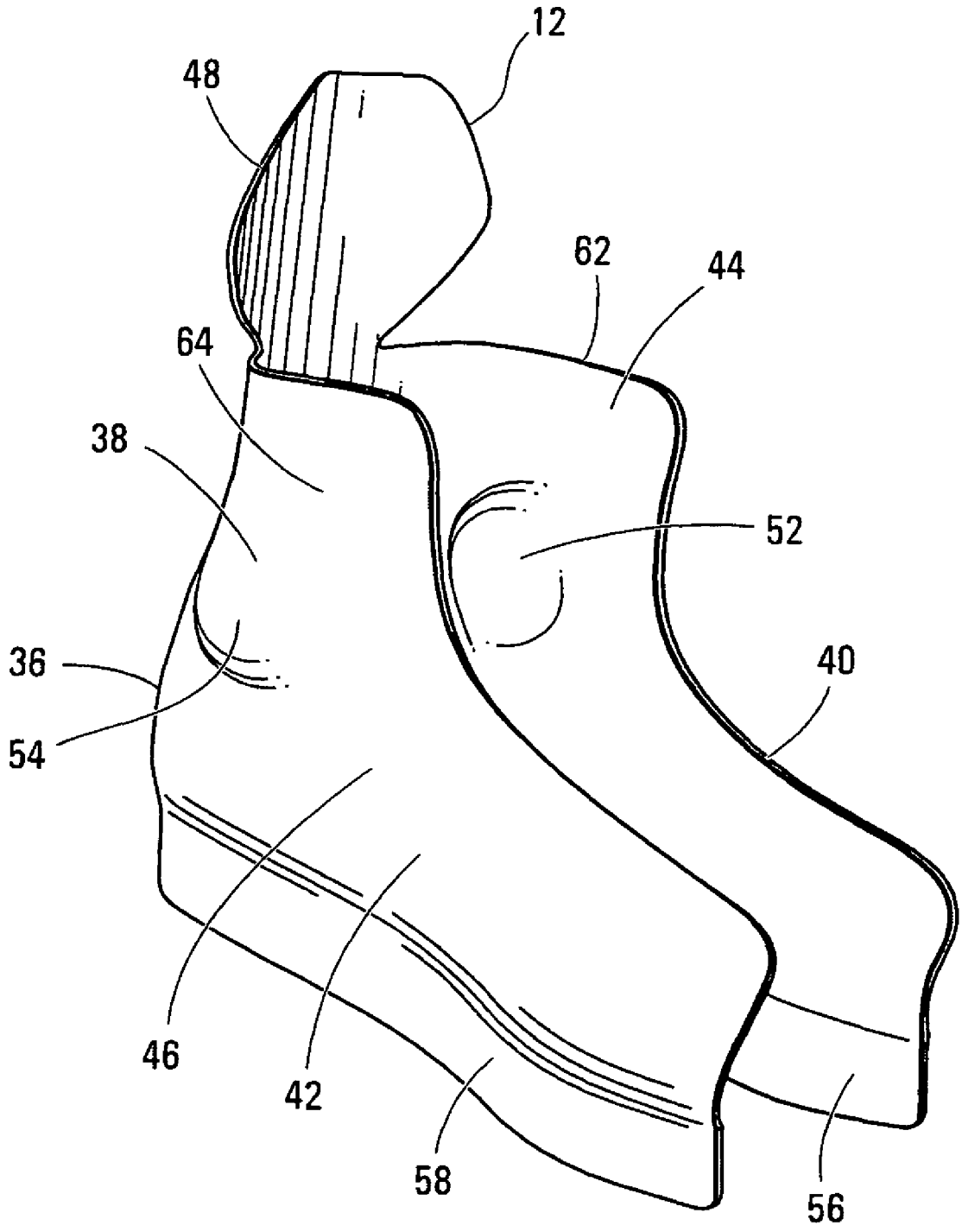
FIG. 5 is a perspective view of the outer shell of FIGS. 3 and 4, wherein the outer shell is in a partial state of completion.

As shown in FIGS. 5 and 6, the medial and lateral skirt portions 56, 58 may have equal widths, such that when folded inwardly they are affixed together along a central longitudinal axis of the outer shell 12. It should be understood, however, that the medial and lateral skirt portions can be of different widths, such that when they are folded inwardly, they are affixed together along a longitudinal line that is closer to either the medial side portion 40 or the lateral side portion 42.

In yet another alternative embodiment, it is possible that the medial and lateral skirt portions 56 do not have a constant width along their entire length. For example, the width of the medial skirt portion 56 might be greater at a position closer to the heel portion 36, and decrease in width as it extends away from the heel portion 36, and the width of the lateral skirt portion 56 might be less at a position closer to the heel portion 36, and increase in width as it extends away from the heel portion 36. In such an embodiment, when the medial and lateral skirt portions 56 are folded inwardly, they may be affixed together along a substantially diagonal line.

Figure 7:
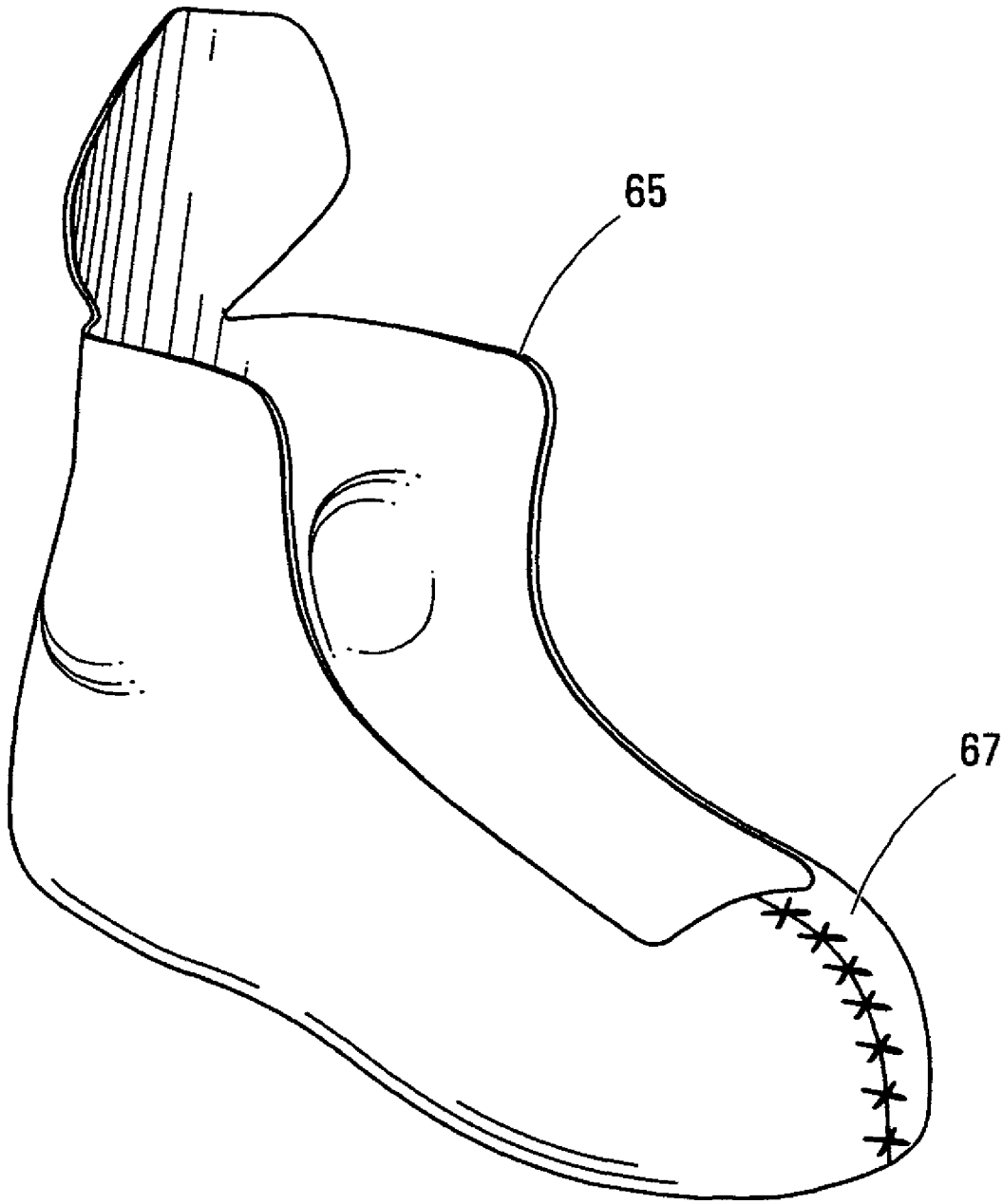
FIG. 7 is a perspective view of an outer shell in accordance with a second embodiment of the present invention.

Shown in FIG. 7, is an outer shell 65 in accordance with a second embodiment of the invention. Outer shell 65 is identical to the outer shell 12 to the exception that it comprises an integrated toe portion 67 for covering the toes T. Because the outer shell 65 comprises an integrated toe portion 67, there is no need for a separate toe cap 14 that is secured to the outer shell 12 as illustrated in FIG. 4. An outer toe protector as the one disclosed in U.S. Pat. Nos. 6,505,422 and 6,647,576 can be used for covering the toe portion 67 of the outer shell 65. It is understood that the sole of the outer shell 65 may further comprise a portion that faces bottom surface of the toes T.

Figure 8:
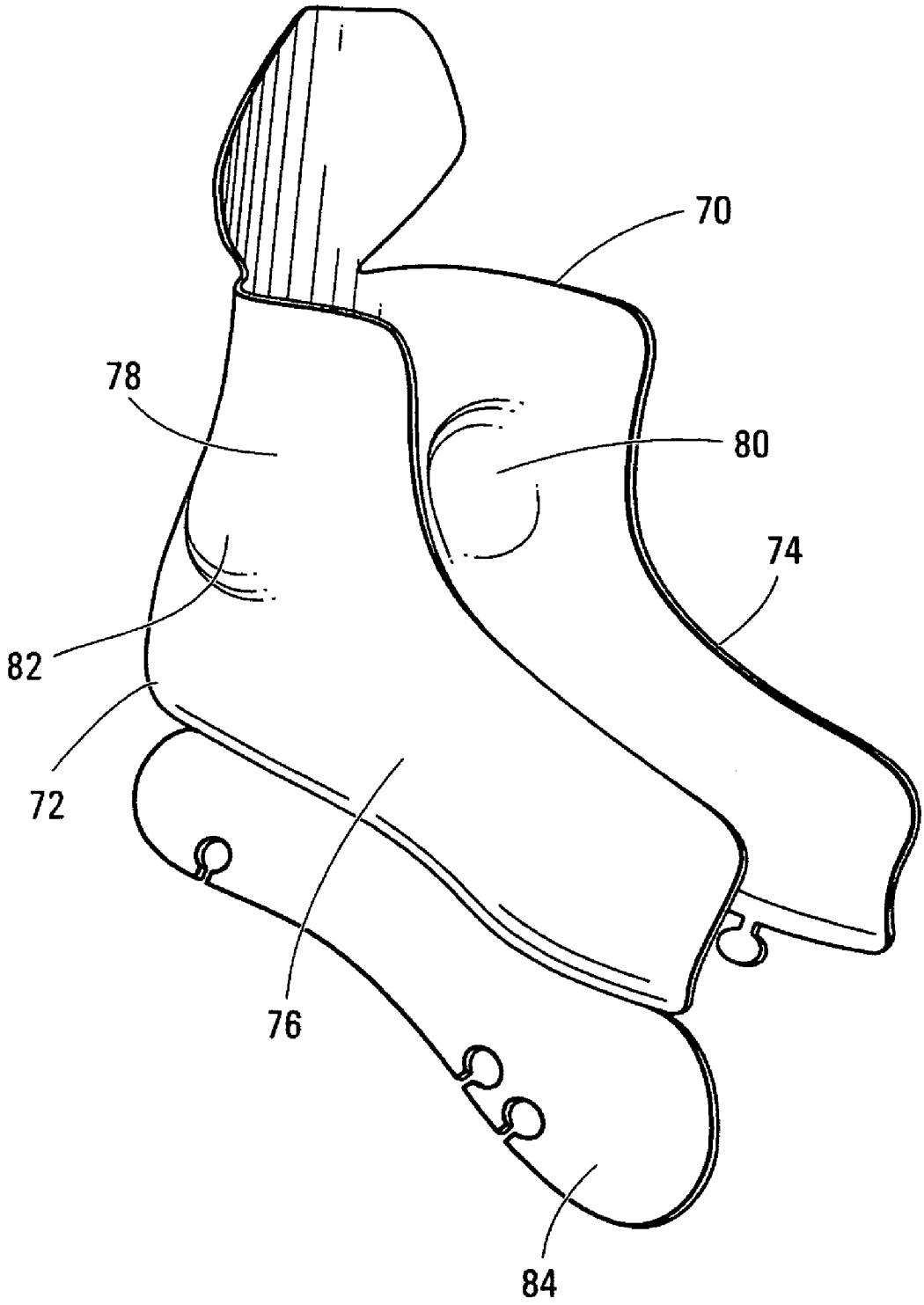
FIG. 8 is a perspective view of an outer shell in accordance with a third embodiment of the present invention in a partial state of completion.

Shown in FIG. 8 is an outer shell 70 in accordance with a third embodiment of the present invention. The outer shell 70 has a heel portion 72 for receiving the heel H, medial and lateral side portions 74, 76 for facing the medial and lateral sides MS, LS and an ankle portion 78 with a medial cup-shaped depression 80 and a lateral cup-shaped depression 82. The outer shell 70 has a skirt portion 84 that extends from, and is integrally formed with, the lateral side portion 76. It should be understood that the skirt portion 84 may extend from the medial side portion 74 without departing from the spirit of the invention.

As shown in FIG. 8, the skirt portion 84 is of substantially the same shape as the gap formed between the medial and lateral side portions 74, 76. As such, when the skirt portion 84 is folded inwardly, it spans the gap between the medial and lateral side portions 74, 76, so as to form a sole facing the plantar surface PS of the foot F. The skirt portion 84 may be affixed to the bottom edge of the medial side portion 74 via a groove and projection arrangement, as shown in FIG. 8. It should however be understood, that the skirt portion 84 can be affixed to the other side of the outer shell 70 via stitching, thermal bonding, piping, zipper, adhesive and staples, among other possibilities known in the art.

Figure 9:
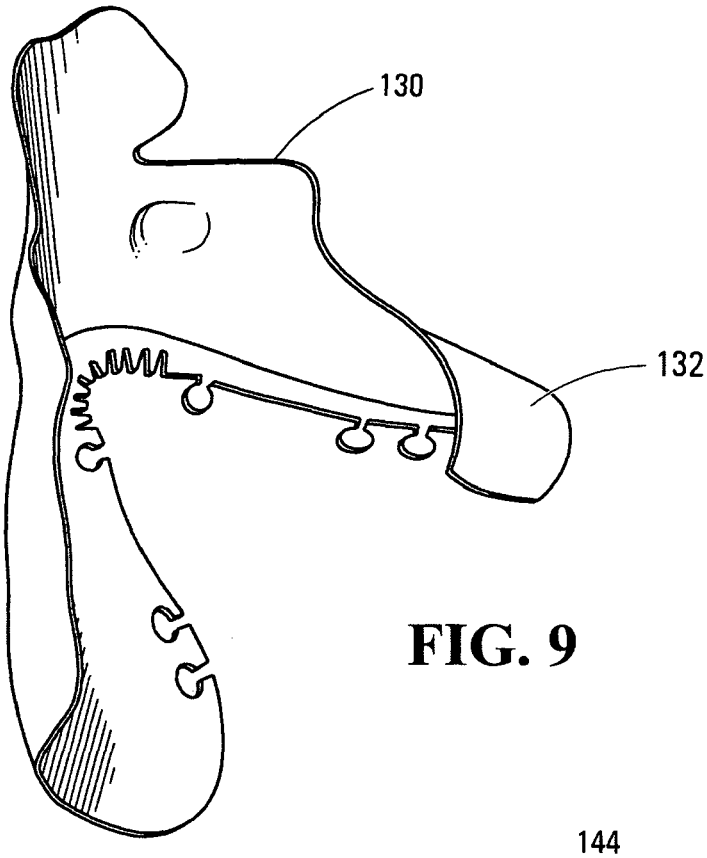
FIG. 9 is a perspective view of an outer shell in accordance with a fourth embodiment of the present invention in a partial state of completion.

Shown in FIG. 9 is an outer shell 130 in accordance with a fourth embodiment of the present invention. Outer shell 130 is substantially the same as the outer shell 70 shown in FIG. 8, however, outer shell 130 has a foldable toe portion 132 that is integrally formed with one of the medial and lateral side portions, and is adapted for being folded inwardly in order to form a toe portion 132 that is integrally formed with the outer shell 130. Because the outer shell 130 comprises an integrated toe portion 132, there is no need for a separate toe cap 14 that is secured to the outer shell 12 as illustrated in FIG. 4. An outer toe protector as the one disclosed in U.S. Pat. Nos. 6,505,422 and 6,647,576 can be used for covering the toe portion 67 of the outer shell 65.

Figure 10:
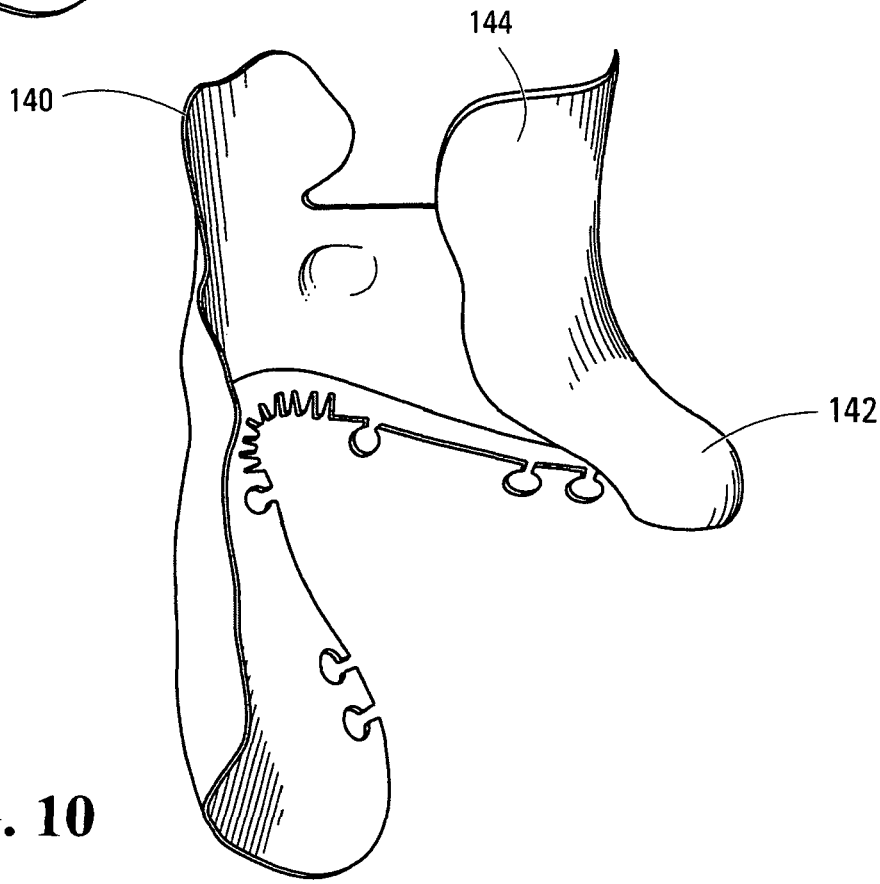
FIG. 10 is a top perspective view of an outer shell in accordance with a fifth embodiment of the present invention in a partial state of completion.

Shown in FIG. 10 is an outer shell 140 in accordance with a fifth embodiment of the present invention. Outer shell 140 is substantially the same as the outer shell 130 shown in FIG. 9, however, in addition to a foldable toe portion 142, the outer shell 140 has a tongue portion 144 that is integrally formed with the toe portion 142, and extends upwardly from the toe portion 142, in order to form a tongue that is integrally formed with the outer shell 140.

Figure 11:
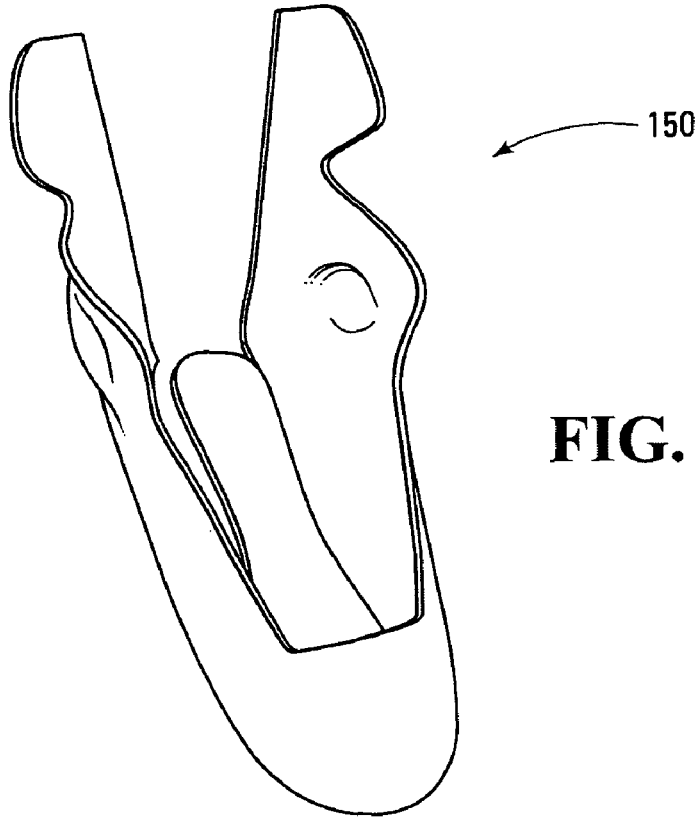
FIG. 11 is a perspective view of an outer shell in accordance with a sixth embodiment of the present invention in a partial state of completion.
Figure 12:
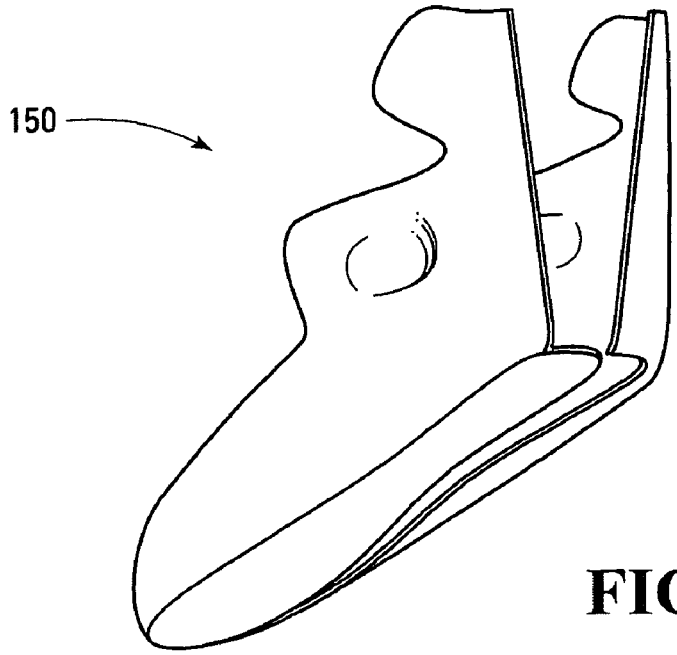
FIG. 12 is a bottom perspective view of the outer shell of FIG. 11.

FIGS. 11 and 12 show another outer shell 150 that is thermoformed such that it comprises a sole integrally formed with one of the medial side portions (the medial side portion as shown in FIGS. 10 and 11) and the medial and lateral side portions may be affixed together at the rear and along the sole.

In a non-limiting embodiment, the thermoformed shells 12, 65, 70, 130, 140, 150 are made of a single sheet made of thermoformable material. However, it should be understood that these thermoformed shells could also be made of multiple sections. For example, the thermoformed shells could be made from separate medial and lateral side portions that are affixed together.

Figure 13:
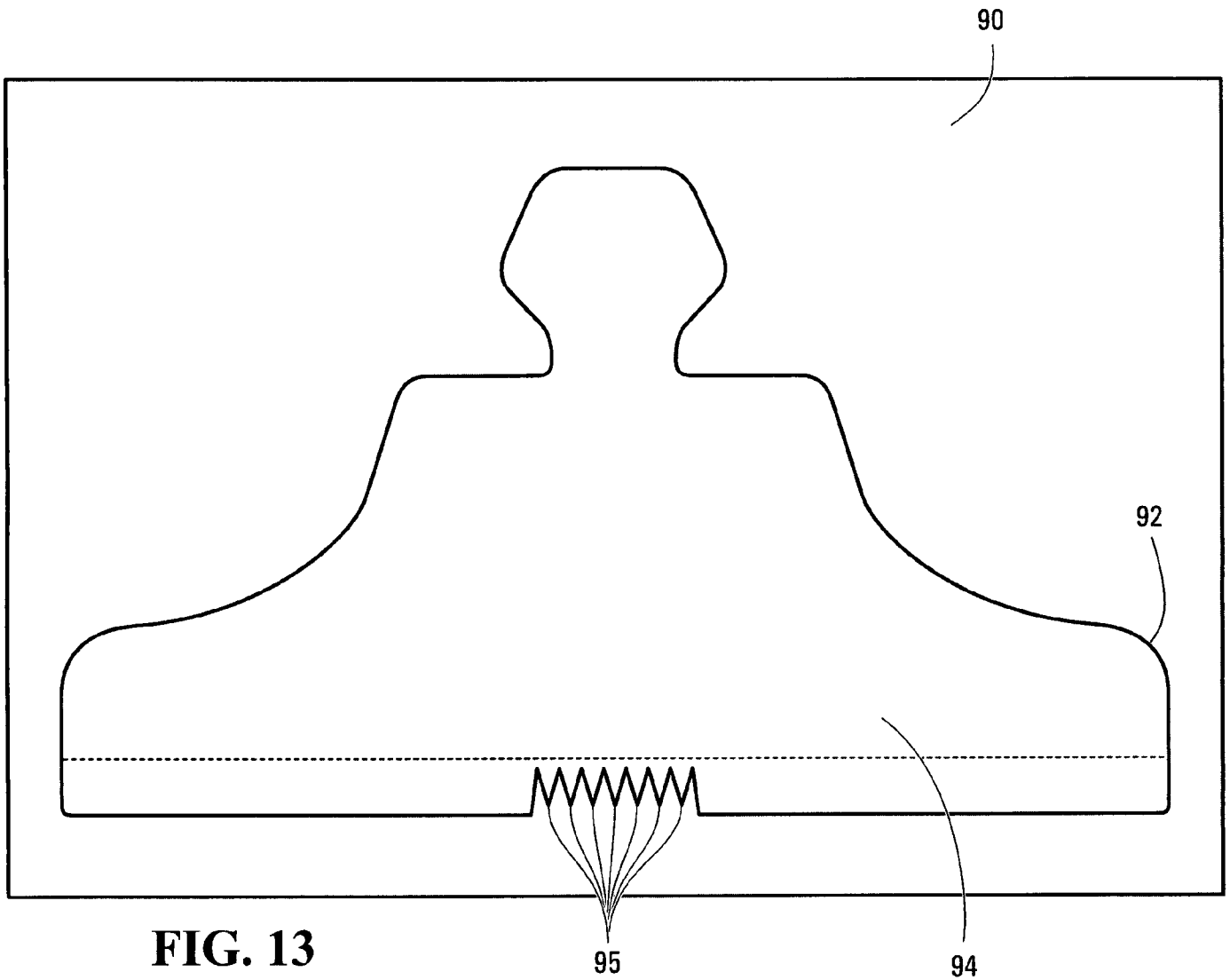
FIG. 13 shows a sheet of thermoformable material.

In order to manufacture the outer shells 12, 65 a pre-cut sheet of thermoformable material may be inserted in the cavity a male-female mold. The male and female portions of the molds define the inner and outer surfaces of the outer shells 12, 65 respectively. Shown in FIG. 13 is a sheet of thermoformable material 90 with a profile 92 of one of the outer shells depicted thereon. Machines and methods for die-cutting a shape 94 from the sheet of material 90 are known in the art, and as such will not be described in more detail herein. As shown in FIG. 13, the shape 94 may include a plurality of projections 95 in the region close to the heel portion.

The pre-cut sheet is aligned and temporarily secured to one of the mold portions using any suitable means to accurately position the pre-cut sheet within the mold and maintain same in position when the mold is closed. Once the mold is closed over the pre-cut sheet, the mold is heated up to the thermoforming temperature of the pre-cut sheet and male and female portions are pressed against the pre-cut sheet.

The pre-cut sheet of thermoformable material may be a composite sheet comprising layers of different thermoformable materials. It is understood that the pre-cut sheet can be thermoformed with a pre-cut sheet of the inner lining 22, instead of securing the inner lining 22 to outer shell 12 after the thermoforming operation. Naturally, the material of the inner lining 22 must be selected from materials that may sustain the thermoforming temperature of the outer shell 12.

In a preferred embodiment of the invention, heat and pressure are applied simultaneously for a period of 15 seconds to 2 minutes after which the mold is allowed to cool down so that the pre-cut sheet will set to the three-dimensional shape defined by the male and female portions of the mold. Preferably, heat and pressure are applied simultaneously for a period of 45 seconds to 1 minute. The applied heat is generally between 250° F. and 350° F., with the preferred temperature being approximately 325° F. The applied pressure is generally between 75 psi and 150 psi, with the preferred pressure being approximately 125 psi. It is understood that the amount of time, temperature and pressure may be different if a cooled mold is used.

Figure 14:
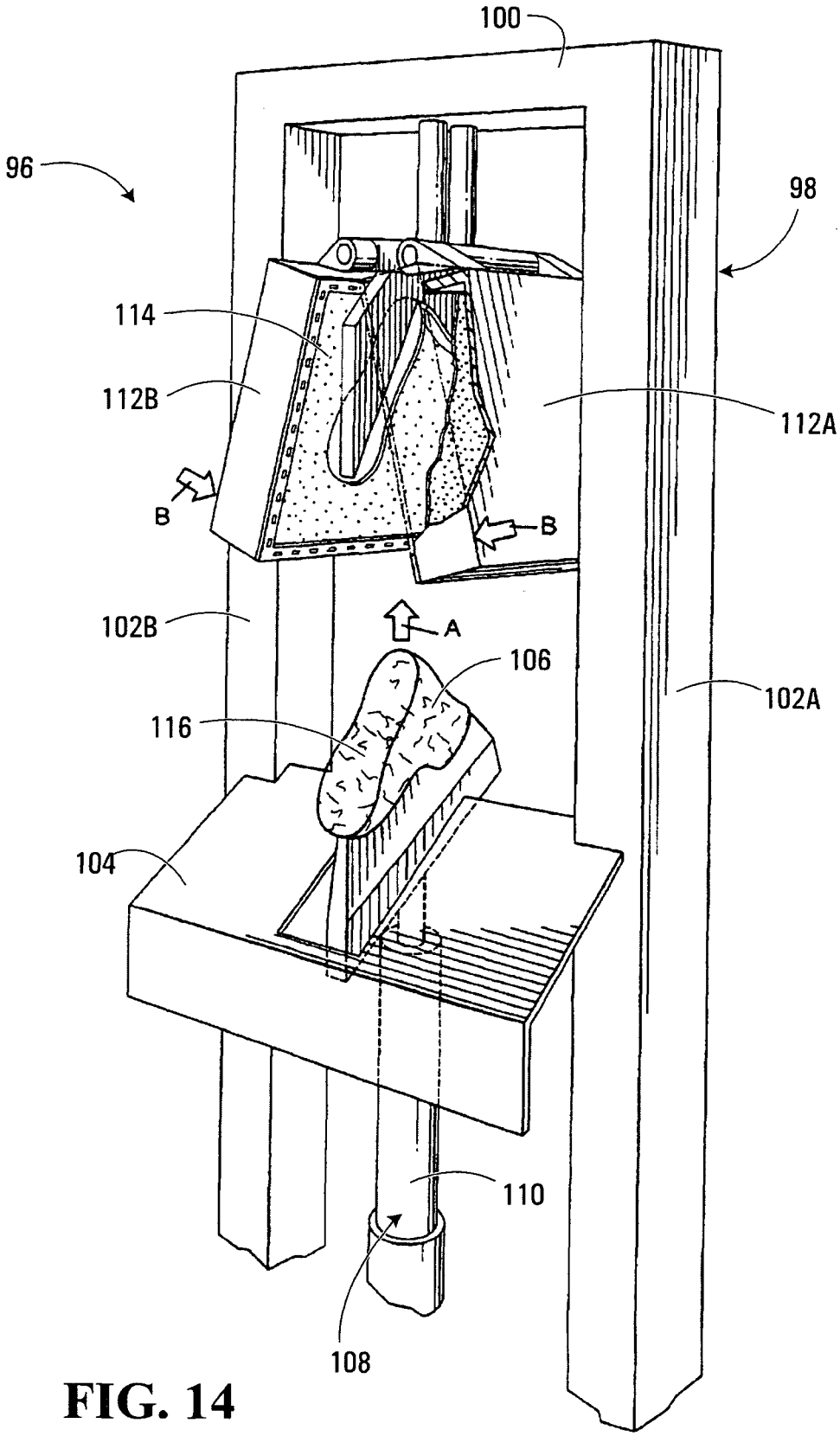
FIG. 14 shows a machine suitable for thermoforming an outer shell in accordance with the present invention.

Instead of using a male-female mold, an apparatus 96 as shown in FIG. 14 may be used for thermoforming a pre-cut sheet of thermoformable material into the shape of the outer shells 12, 65, 70, 130, 140, 150. For the purposes of the present application, the method will be described with respect to the outer shell 12, shown in FIGS. 4 to 6. However, it should be appreciated that the method could also have been described with respect to the outer shells 65, 70, 130, 140, 150.

The first step in manufacturing the outer shell 12 is to die-cut the shape of the outer shell 12 from the sheet of thermoformable material 90 in order to obtain the die cut shape 94.

The sheet of material 90 may be a composite sheet having a layer of thermoformable foam. Some non-limiting examples of different types of thermoformable foam include ethylene vinyl acetate (EVA) foam, polyethylene foam and polypropylene foam. High density polyethylene (HDPE) 1300, 1100 and 0907 foams can also be used. The sheet may be made of thermoforming materials such as those sold under the trade-mark MEGABIX™ (a core of extruded SURLYN®, a backing of SONTARA® and a hot melt coating; thickness of 0.95 mm), FORMO500® (non woven polyester with a core of extruded polyolefinic, stiffening layers of synthetic latex on each side and an ethylene vinyl acetate hot melt adhesive on one side; thickness of 1.50 mm), BYLON® (a nylon multifilament with a backing of black saturated needle punched polyester nonwoven and a face coating of non-fray urethane) and MOSOCA® (NYLON® 66 with a core of SURLYN® and a PU coating). The composite sheet may also be made of a first sheet of polyethylene high density (HDPE) foam; a second sheet of thermoplastic; and a third composite sheet made of a first layer of cotton, a second layer of surlyn fibers, a third layer of a mesh of nylon fibers and a coating. These sheets being laminated together before or during the thermoforming process of the outer shell.

The sheet of material 90 may include two or three layers, wherein the layer that will form the outer surface 46 of the outer shell 12 is more rigid that the layer that will form the inner surface 44 of the outer shell 12. A layer of thermoformable foam may be sandwiched between the inner and outer layers.

The second step in manufacturing the outer shell 12 is to thermoform the die cut shape 94 of thermoformable material into the three-dimensional shape of the outer shell 12 shown in FIG. 6.

Reverting to FIG. 14, the apparatus 96 comprises a supporting frame 98 having an outer shell traverse 100 and two pillars 102A and 102B. The two pillars 102A and 102B are joined together at mid-height by a ledge 104 that contains a control panel (not shown) with control buttons (not shown) for enabling an operator to control the apparatus 96. In the specific embodiment shown, the ledge 104 surrounds a last 106 that is supported by a movable support 108. The movable support 108 is a hydraulic or pneumatic piston cylinder 110 that is movable up and down in a vertical direction, as indicated by arrow A. It should be understood that lasts 106 of different shapes and sizes can be installed on apparatus 96 in order to manufacture outer shells 12 of different shapes and sizes.

The apparatus 96 further comprises a pair of clamps 112A, 112B that are mounted to the outer shell traverse 100 and positioned directly above last 106. Clamps 112A, 112B are adapted to open and close, as indicated by arrows B in order to clamp around the last 106. The clamps 112A, 112B comprise pressure pads 114 for receiving the shape 94 of thermoformable material. In addition, each of the clamps 112A, 112B comprises a bladder (not shown) having an inflated membrane and a fluid pressure delivery circuit (not shown) for causing the membrane to inflate, such that it is able to surround the last 106 during use.

In operation, the die-cut shape 94 of thermoformable material is placed on the last 106 and is accurately positioned and secured in place via the use of clips (not shown). Once the shape 94 of thermoformable material is securely in place, the operator activates the apparatus 96 which causes the piston-cylinder 110, and therefore the last 106, to raise up between the two open clamps 112A, 112B. When the last 106 reaches the pressure pads 114, the piston-cylinder 110 reaches a set value and stops. It should be understood that in an alternative embodiment, the last 106 can remain stationary, and the clamps 112A, 112B can be connected to piston-cylinders for lowering the clamps 112A, 112B around the last 106.

Once the last 106 is positioned between clamps 112A, 112B, the clamps 112A, 112B begin to close thereby causing the pressure pads 114 to apply an initial pressure to the shape 94 of thermoformable material positioned on the last 106. When the clamps 112A, 112B are completely closed, the bladders are then inflated by air or liquid injection, which forces the flexible membranes of the bladders to encircle the shape 94 of thermoformable material around the last 106 and apply pressure thereto. Once the pressure within the bladders has reached a set value wherein the bladder membranes apply an even pressure to the thermoformable material, the pressure is maintained for a certain amount of time, and is then released. In a non-limiting embodiment, a pressure of between 30 psi and 120 psi is maintained around the last 106 for approximately 1 to 2 minutes. In addition to the pressure, heat is also applied to the thermoformable material. The applied heat is generally between 250° F. and 550° F., with the preferred temperature being approximately 350° F. Once heated, the thermoformable material becomes malleable and, as such, is able to acquire the three-dimensional shape applied to it by the last 106.

In accordance with a first example, when the bladders 114 apply pressure and heat to the shape 94 of the thermoformable material, they are able to press the thermoformable material around the last, and are also able to cause the medial and lateral skirt portions 56, 58 to fold inwardly, such that they are pushed against the sole portion 116 of the last for forming the sole 60.

In accordance with an alternative example, the thermoforming process is a two part-procedure, wherein in the first stage the clamps 112A, 112B as described above are able to thermoform the outer shell 12 into the partial state of completion, as shown in FIG. 5, wherein the medial and lateral skirt portions 56, 58 have not yet have been folded inwardly. In the second stage of the thermoforming procedure, other clamps (not shown) fold the two skirt portions 56, 58 inwardly, and apply the necessary pressure and heat thereto in order to thermoform the two skirt portions 56, 58 into the sole 60.

In either case, once the outer shell 12 has been thermoformed into the final shape shown in FIG. 6, the last 106 is lowered by the piston cylinder 110 to its original position. The medial and lateral skirt portions 56, 58 may be affixed together. The step of affixing the medial and lateral skirt portions 56, 58 together can be performed while the outer shell 12 is on the last 106.

Reverting to FIG. 4, the method of assembling the ice skate 1 will be described. The first step in assembling the skate boot 10 is to insert the rigid ankle support 26 into the outer shell 12 in order to provide more support and rigidity in that general area. It should be understood that the rigid ankle support 26 is an optional component, and that there is no need to include it if the outer shell 12 has enough rigidity.

The inner lining 22 is then glued or sewed to the inner surface 44 of outer shell 12. The inner lining 22 is made of a layer of soft material such as a sheet of polyester laminated with a layer of foam, or a layer of fabric made from 100% nylon fibers. The inner lining 22 comprises an inner surface that is adapted to contact the skin of the foot F in use.

As shown in FIG. 4, two narrow bands 30 are secured to the upper portion of each of the side portions 40, 42. The narrow bands 30 are made of fabric, textile or leather. In an alternative embodiment, a single continuous band that covers the upper portion of each of side portions 40, 42 and wraps around the rear of the ankle portion 38 can be used instead of two distinct bands 30.

Apertures 32 are then punched through the narrow bands 30, the outer shell 12 and the inner lining 22. Once punched, the apertures 32 are reinforced by metallic rivets 34 or any suitable means as is well known in the art of footwear construction.

The tongue 24 and toe cap 14 are then affixed to the outer shell 12. In a non-limiting embodiment, the toe cap 14 and the tongue 24 are pre-assembled prior to installation to outer shell 12. The tongue 24 is affixed to the toe cap 14 and extends upwardly and rearwardly from the toe cap 14 for covering the forefoot of the foot F. The frontal edge of tongue 24 can be sewn directly to toe cap 14 or can be fixed in an alternative manner known in the art. The toe cap 14 can be secured to the outer shell 12 by sewing both sides of toe cap 14 to the side portions 40, 42.

A last may be inserted into the inside cavity of the outer shell 12 in order to complete the construction of the boot. The last enables the outer shell 12 to maintain its shape when the skirt portions 56, 58 are folded and affixed together. As shown in FIGS. 4 and 6, the skirt portions 56, 58 may be affixed together via stitching 59 along a longitudinal central line. As indicated previously, the skirt portions 56, 58 may be affixed together in a variety of different manners without departing from the spirit of the invention, such as via adhesive, thermal bonding, piping, zipper staples and a projection/groove arrangement. Once the skirt portions 56, 58 are firmly attached together to form the sole 60 and the boot has acquired its final shape, a light sanding of the sole 60 may be performed to partially even the lower surface of the boot and provide a flat surface on which the blade holder 16 can be mounted via adhesive, rivets, screws, nails, or any other mounting means known in the art. An outsole such as the outsole 31 shown in FIG. 4 may be affixed to the sole 60 and the blade holder 16 may then be mounted on the outsole 31 instead of being directly mounted on the sole 60. As indicated previously, the outsole 31 is an optional component and may not be required if the rigidity of the sole 60 is sufficient.

Alternatively, an insole such as the insole 29 shown in FIG. 4 may be positioned inside the skirt portions 56, 58. As indicated previously, the insole 29 is an optional component. Once the assembly of the upper boot is completed, the upper boot is placed upside down into a lasting machine. Glue is first applied to the bottom surface of the insole 29 along its periphery. Skirt portions 56, 58 are then folded over the last onto the bottom surface of the insole 29. Once folded, skirt portions 56, 58 form the sole 60 that is bonded to the insole 29 by the glue that was previously laid on the bottom surface of the insole 29. The skirt portions 56, 58 are further nailed, stitched, or tacked all around the insole 29 to provide the necessary mechanical grip and allow the glue to properly set between the sole 60 and the insole 29. Once the sole 60 is firmly attached to the insole 29 and the boot has acquired its final shape, a light sanding of the sole 60 may be performed to partially even the lower surface of the boot and provide a flat surface on which the outsole 31 or blade holder 16 can be mounted via adhesive, rivets, screws, nails, or any other mounting means known in the art.

A footbed 28 can be inserted into the outer shell 12 in order to sit upon the sole 60 formed by the two skirt portions 56, 58. In this manner, the footbed 28 covers the seam where the two skirt portions 56, 58 meet, or in the case of outer shell 70, the footbed 28 covers the seam where the skirt portion 84 meets one of the side portions.

The footbed 28 has an upper surface 120 for receiving the plantar surface PS of the foot F, and a padding wall 122 that projects upwardly from the upper surface for partially cupping the heel H and extending up to a medial line of the foot F.

It is understood that the boot 10 may comprise a roller chassis mounted to the bottom surface of the sole 60, a roller chassis mounted to the outsole 31 covering the sole 60 or a walking, trekking, hiking, cross-country skiing, football, basketball or soccer outsole mounted to the sole 60.

The above description of the embodiments should not be interpreted in a limiting manner since other variations, modifications and refinements are possible within the spirit and scope of the present invention. The scope of the invention is defined in the appended claims and their equivalents.

The invention claimed is:

1. A method of manufacturing an ice skate for enclosing a human foot when in use, the foot having a heel, an ankle with a medial malleolus and a lateral malleolus, a plantar surface, medial and lateral sides and toes, said method comprising:

(a) providing a sheet of thermoformable material;

(b) thermoforming said sheet of thermoformable material to form an outer shell comprising (i) a heel portion for receiving the heel of the foot; (ii) an ankle portion for receiving the ankle; (iii) medial and lateral side portions for facing the medial and lateral sides of the foot respectively, said medial and lateral side portions extending forwardly from said heel portion and said ankle portion, one of said medial and lateral side portions comprising a skirt portion being integrally formed therewith;

(c) folding said skirt portion to form a sole having an upper surface for facing the plantar surface of the foot and a bottom surface; and (d) mounting an ice skate blade holder to said bottom surface of said sole.

2. A method as defined in claim 1, further comprising affixing said skirt portion to the other one of said medial and lateral side portions via one of stitching, staples, adhesive, piping, zipper, thermal bonding and a groove and projection arrangement.

3. A method as defined in claim 1, further comprising affixing an inner lining to an inner surface of said outer shell, said inner lining comprising a surface intended for contact with the heel, ankle and lateral and medial sides of the foot.

4. A method of manufacturing an ice skate for enclosing a human foot when in use, the foot having a heel, an ankle with a medial malleolus and a lateral malleolus, a plantar surface, medial and lateral sides and toes, said method comprising:

(a) providing a sheet of thermoformable material;

(b) thermoforming said sheet of thermoformable material to form an outer shell that comprises: (i) a heel portion for receiving the heel of the foot; (ii) an ankle portion for receiving the ankle; (iii) medial and lateral side portions for facing the medial and lateral sides of the foot respectively, said medial and lateral side portions extending forwardly from said heel portion and said ankle portion; said medial and lateral side portions each comprising a respective medial and lateral skirt portion being integrally formed therewith;

(c) folding said medial and lateral skirt portions inwardly to form a sole having an upper surface for facing the plantar surface of the foot and a bottom surface; and (d) mounting an ice skate blade holder to said bottom surface of said sole.

5. A method as defined in claim 4, further comprising affixing said medial and lateral skirt portions together via one of stitching, staples, adhesive, piping, zipper thermal bonding and a groove and projection arrangement.

6. A method as defined in claim 4, further comprising affixing an inner lining to an inner surface of said outer shell, said inner lining comprising a surface intended for contact with the heel, ankle and lateral and medial sides of the foot.

7. A method as defined in claim 4, further comprising affixing a toe cap to said medial and lateral side portions of said outer shell.

8. A method as defined in claim 7, further comprising affixing a tongue to said toe cap.

9. A method of manufacturing an ice skate for enclosing a human foot when in use, the foot having a heel, an ankle with a medial malleolus and a lateral malleolus, a plantar surface, medial and lateral sides and toes, said method comprising:

(a) providing a sheet of thermoformable material;

(b) thermoforming said sheet of thermoformable material to form an outer shell comprising (i) a heel portion for receiving the heel of the foot; (ii) an ankle portion for receiving the ankle; (iii) medial and lateral side portions for facing the medial and lateral sides of the foot respectively, said medial and lateral side portions extending forwardly from said heel portion and said ankle portion, one of said medial and lateral side portions comprising a skirt portion being integrally formed therewith;

(c) folding said skirt portion to form a sole having an upper surface for facing the plantar surface of the foot and a bottom surface;

(d) mounting an outsole to said bottom surface of said sole; and (e) mounting a skate blade holder to a bottom surface of said outsole.

10. A method as defined in claim 9, further comprising affixing said skirt portion to the other one of said medial and lateral side portions via one of stitching, staples, adhesive, piping, zipper, thermal bonding and a groove and projection arrangement.

11. A method as defined in claim 9, further comprising affixing an inner lining to an inner surface of said outer shell, said inner lining comprising a surface intended for contact with the heel, ankle and lateral and medial sides of the foot.

12. A method of manufacturing an ice skate for enclosing a human foot when in use, the foot having a heel, an ankle with a medial malleolus and a lateral malleolus, a plantar surface, medial and lateral sides and toes, said method comprising:

(a) providing a sheet of thermoformable material;

(b) thermoforming said sheet of thermoformable material to form an outer shell that comprises: (i) a heel portion for receiving the heel of the foot; (ii) an ankle portion for receiving the ankle; (iii) medial and lateral side portions for facing the medial and lateral sides of the foot respectively, said medial and lateral side portions extending forwardly from said heel portion and said ankle portion; said medial and lateral side portions each comprising a respective medial and lateral skirt portion being integrally formed therewith;

(c) folding said medial and lateral skirt portions inwardly to form a sole having an upper surface for facing the plantar surface of the foot and a bottom surface;

(d) mounting an outsole to said bottom surface of said sole; and (e) mounting a skate blade holder to a bottom surface of said outsole.

13. A method as defined in claim 12, further comprising affixing said medial and lateral skirt portions together via one of stitching, staples, adhesive, piping, zipper thermal bonding and a groove and projection arrangement.

14. A method as defined in claim 12, further comprising affixing an inner lining to an inner surface of said outer shell, said inner lining comprising a surface intended for contact with the heel, ankle and lateral and medial sides of the foot.

15. A method as defined in claim 12, further comprising affixing a toe cap to said medial and lateral side portions of said outer shell.

16. A method as defined in claim 15, further comprising affixing a tongue to said toe cap.

* * * * *